US007858565B2

(12) United States Patent
Tynik et al.

(10) Patent No.: US 7,858,565 B2
(45) **Date of Patent: *Dec. 28, 2010**

(54) ANTIOXIDANT ADDITIVE FOR LUBRICANT COMPOSITIONS, COMPRISING ORGANOTUNGSTATE

(75) Inventors: Robert John Tynik, Norwalk, CT (US); Steven G. Donnelly, Bethel, CT (US); Gaston A. Aguilar, Milford, CT (US)

(73) Assignee: R.T. Vanderbilt Company, Inc., Norwalk, CT (US)

( * ) Notice: Subject to any disclaimer, the term of this patent is extended or adjusted under 35 U.S.C. 154(b) by 883 days.

This patent is subject to a terminal disclaimer.

(21) Appl. No.: 11/743,409

(22) Filed: May 2, 2007

(65) Prior Publication Data

US 2007/0203032 A1 Aug. 30, 2007

Related U.S. Application Data

(60) Provisional application No. 60/746,515, filed on May 5, 2006.

(51) Int. Cl.
*C10M 125/20* (2006.01)

(52) U.S. Cl. ..... 508/165; 508/243

(58) Field of Classification Search ..... 508/170, 508/243, 165

See application file for complete search history.

(56) References Cited

U.S. PATENT DOCUMENTS

| | | | | |
|---|---|---|---|---|
| 3,290,245 | A * | 12/1966 | Elliott et al. | 508/362 |
| 5,137,980 | A * | 8/1992 | DeGonia et al. | 525/327.6 |
| 5,605,880 | A | 2/1997 | Arai et al. | |
| 5,840,672 | A | 11/1998 | Gatto | |
| 5,994,277 | A | 11/1999 | Ritchie et al. | |
| 6,150,309 | A | 11/2000 | Gao et al. | |
| 6,174,842 | B1 | 1/2001 | Gatto et al. | |
| 6,358,894 | B1 | 3/2002 | Leta et al. | |
| 6,806,241 | B2 | 10/2004 | Karol et al. | |
| RE38,929 | E | 1/2006 | Gatto et al. | |
| 7,335,625 | B2 * | 2/2008 | Tynik | 508/362 |
| 2004/0214731 | A1 * | 10/2004 | Tynik | 508/362 |
| 2006/0025313 | A1 | 2/2006 | Boffa | |
| 2006/0079411 | A1 | 4/2006 | Winemiller et al. | |
| 2006/0094607 | A1 | 5/2006 | Devlin et al. | |
| 2007/0042917 | A1 | 2/2007 | Ravichandran et al. | |

OTHER PUBLICATIONS

See U.S. Appl. No. 11/743,955, filed May 3, 2007.

* cited by examiner

*Primary Examiner*—Glenn Caldarola
*Assistant Examiner*—Jim Goloboy
(74) *Attorney, Agent, or Firm*—Norris, McLaughlin & Marcus, P.A.

(57) ABSTRACT

The invention relates an additive for improving antioxidant capabilities in a lubricating composition, where the lubricating composition is based on a major amount of a lubricating oil and 0.1-5.0 mass percent of an additive, the additive including a secondary diarlyamine and an organoammonium tungstate.

13 Claims, No Drawings

ANTIOXIDANT ADDITIVE FOR LUBRICANT COMPOSITIONS, COMPRISING ORGANOTUNGSTATE

FIELD OF THE INVENTION

The present invention relates to lubricant compositions for imparting improved antioxidant properties. In particular, the invention relates to novel antioxidant compositions containing diarylamine antioxidant(s) in combination with organoammonium tungstate compound(s), which demonstrate a synergistic combination providing significantly higher antioxidant activity than either of the components separately when used in lubricants.

BACKGROUND OF THE INVENTION

Engine oils function under severe oxidative conditions. The oxidative breakdown of the engine oil creates sludge and deposits, deteriorates the viscosity characteristics of the oil, and produces acidic bodies that corrode engine parts. To combat the effects of oxidation, engine oils are formulated with an array of antioxidants including hindered phenols, aromatic amines, zinc dithiophosphates (ZDDP), sulfurized hydrocarbons, metal and ashless dithiocarbamates, and organo-molybdenum compounds. Particularly effective antioxidants are alkylated diphenylamines (ADPAs), and ZDDPs. In combination, these two compounds provide the majority the of the antioxidant capacity in engine oils under current practice. In addition, ZDDP is the main source of antiwear protection for engine oils. However, the use of ZDDP in engine oils is declining due to the poisoning effect of phosphorus on exhaust after-treatment catalyst. In addition, sulfur levels in engine oils are also in decline due to the effect of sulfated ash exhaust after-treatments. Thus, a need exists for effective antioxidant chemistry that can reduce or eliminate the need for phosphorus and sulfur containing antioxidants and antiwear additives.

In U.S. Patent Application 2004/0214731 A1, Tynik discloses that organoammonium tungstate compounds are effective antiwear additives without contributing phosphorus or sulfur to a lubricating composition The invention herein teaches that unlike ZDDP, these organoammonium tungstate compounds alone do not effectively inhibit oxidation of lubricating compositions. However, in the presence of secondary diarylamines, organoammonium tungstate compounds acts synergistically to provide oxidation control much improved over either of the components separately. Thus, organoammonium tungstates represent a technology that will reduce or eliminate the need for phosphorus and sulfur containing additives such as ZDDP.

SUMMARY OF THE INVENTION

It has now been discovered that a combination of (A) secondary diarylamine antioxidant(s) and (B) organoammonium tungstate compound(s) provides significantly improved antioxidation performance to lubricating oil compositions. The tungstate acts synergistically with the antioxidant(s), providing oxidation control much improved over that provided by either of the components separately.

DETAILED DESCRIPTION

The secondary diarylamines used in this invention should be soluble in the formulated oil package or package concentrate:

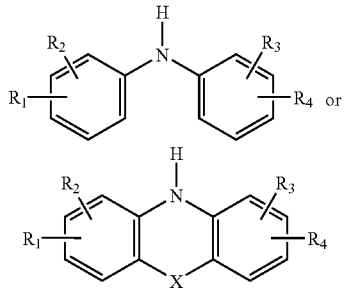

wherein $R_1$, $R_2$, $R_3$, and $R_4$ each independently represent hydrogen, alkyl, aralkyl, aryl, and alkaryl groups having 1 to about 20 carbons atoms per each group. Preferred groups are hydrogen, 2-methyl propenyl, 2,4,4-trimethyl pentenyl, styrenyl, and nonyl. The cyclic structure may be represented when X is either $(CH_2)_n$, S, or O and n is 0 to 2. Examples of these cyclic compounds are carbazoles, acridines, azepines, phenoxazines and phenothiazines. Preferred are non-cyclic secondary diarylamines.

For this invention, organoammonium tungstates are prepared from the reaction of acidic forms of oxotungsten and organo compounds containing basic nitrogen or amines. Possible tungsten sources are listed but not limited to those in Table 1. Of these sources, tungstic acid, ammonium tungstate, ammonium paratungstate, and ammonium metatungstate react directly with amines. Tungsten trioxide is basic anhydride which must be hydrolyzed to produce tungstic acid. A preferred method of hydrolyzing tungsten trioxide is described by Tynik, U.S. Patent Application 2004/0214731 A1, incorporated herein by reference. In this method, tungsten trioxide is hydrolyzed with 2 equivalents caustic to produce metal tungstate hydrate that is then acidified with 2 equivalents of acid to form tungstic acid. Alternatively, tungstic acid can be produce directly from the acidification of commercially available metal tungstates such as sodium tungstate dihydrate and calcium tungstate. Polyoxotungstates, $[W_xY_y(OH)_z]^{n-}$, are formed when less than 2 equivalents of acid are used to neutralize metal tungstates, and can also be used to form organoammonium tungstates.

TABLE 1

Tungsten Sources

| Chemical Name | Chemical Formula |
|---|---|
| tungsten trioxide | $WO_3$ |
| tungstic acid | $H_2WO_4$ or $WO_3 \bullet H_2O$ |
| ammonium tungstate | $(NH_4)_2WO_4$ |
| sodium tungstate dihydrate | $(Na)_2WO_4 \bullet 2\ H_2O$ |
| calcium tungstate | $CaWO_4$ |
| ammonium paratungstate | $(NH_4)_{10}\ (HW_{12}O_{42}) \bullet 4H_2O$ |
| ammonium metatungstate | $(NH_4)_6\ (HW_{12}O_{40}) \bullet xH_2O$ wherein x is typically 3 or 4. |

For purposes as a reactant with the tungsten source, reactant amines will be defined as compounds containing basic nitrogen that can be measured by ASTM D 2896, Standard Test Method for base Number of Petroleum Products by Potentiometric Perchloric Acid Titration. It is expected that most amine compounds will undergo an acid/base reaction with tungsten sources described above. The primary requirement of the amine is to make oil-soluble tungstate products. Preferred are alkyl mono-amines of U.S. Patent Application 2004/0214731 A1 and polyamine dispersants, which are essential components used in engine oils.

Alkyl mono-amines consist of the formula $R_5R_6NH$ wherein $R_5$ and $R_6$ are identical or different and selected from group consisting of hydrogen, linear or branched, saturated or unsaturated alkyl group containing 8 to 40 carbon atoms, or alkoxy groups containing 1 to 12 carbon atoms. Most preferred is di-($C_{11}$-$C_{14}$-branched and linear alkyl) amine, also known as 'di-tridecylamine', available from BASF Corporation, and di-n-octylamine Polyamine dispersants are based on polyalkenylamine compounds:

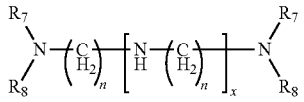

wherein $R_7$ and $R_8$ are independently hydrogen, linear or branched alkyl groups containing 1 to 25 carbon atoms, alkoxy groups containing 1 to 12 carbon atoms, alkylene groups containing 2 to 6 carbon atoms, and hydroxyl or amino alkylene groups containing 2 to 12 carbon atoms, x is 2 to 6, preferably 2 to 4, and n is 0 to 10, preferably 2 to 6. Particularly most preferred are triethylene tetramine, tetraethylene pentamine, and mixtures thereof in which $R_7$ and $R_8$ are both hydrogen, x is 2 to 3, and n is 2.

Polyamine dispersants are prepared by the reaction of polyalkenylamine compounds with carboxylic acids (ROOH) or reactive derivatives thereof; alkyl or alkenyl halides (R—X) and alkyl or alkenyl substituted succinic acid to respectively form carboxylic acid amides, hydrocarbyl substituted polyalkenylamines, and succinimides:

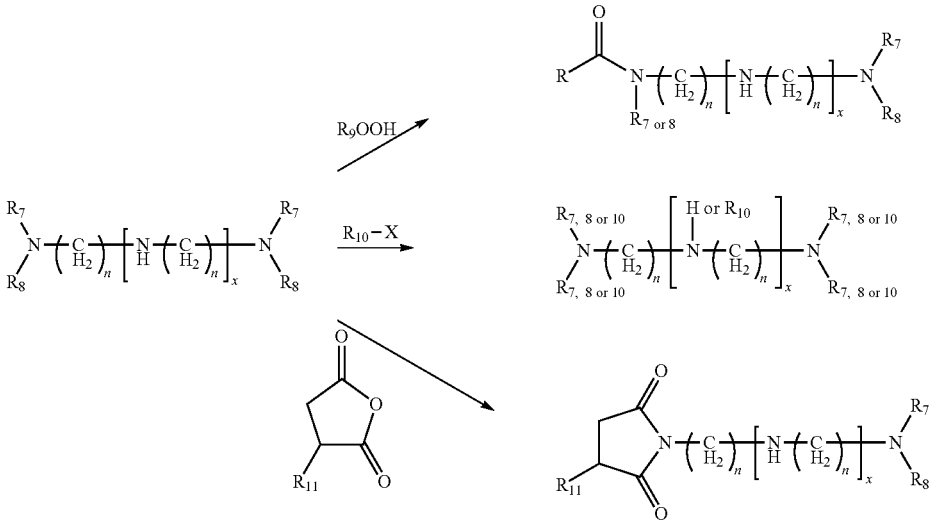

Typical of carboxylic acid amides are those disclose in U.S. Pat. No. 3,405,064, the disclosure of which is incorporated by reference. The products are either mono carboxylic acid amides as shown above or poly carboxylic acid amides in which more than one of the primary and secondary amines (—NH and $NH_2$) are transformed to carboxylic acid amides. The $R_9$ groups in carboxylic acid are 12 to 250 aliphatic carbon atoms. Preferred $R_9$ groups contain 12 to 20 carbon atoms and polyisobutenyl chains (PIB) containing 72 to 128 carbon atoms.

Typical hydrocarbyl substituted polyalkenylamine compounds are disclosed in U.S. Pat. No. 3,574,576, the disclosure of which is incorporated by reference. The products are mono or poly substituted. Hydrocarbyl groups, $R_{10}$, are preferably 20 to 200 carbons atoms. Particularly preferred halides used in the formation of hydrocarbyl polyalkenylamine compounds are polyisobutenyl chlorides which contain 70 to 200 carbon atoms.

The preferred polyamine dispersants of this invention are the succinimides which are either mono or bis substituted and most preferred are mono-substituted succinimides:

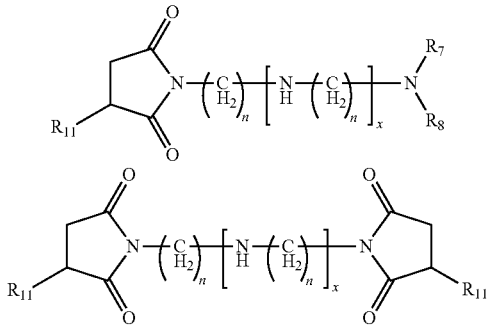

wherein $R_{11}$ is 8 to 400 carbon atoms and preferably 50 to 200 carbon atoms. Particularly preferred are succinimide dispersants which are derived from polyisobutenyl having molecular weight ranging from 800-2,500 grams per mole and polyethyleneamines such as triethylene tetramine, tetraethylene pentamine, and mixtures thereof. Specific commercial example of mono-substituted succinimide dispersant is Chevron ORONITE® OLOA 371, and OLOA 11,000, concentrated version of OLOA 371. Specific example of bis-substituted succinimide dispersant is HiTEC® 644 supplied by Afton Chemical.

Another type of dispersant is polyamine grafted viscosity index (VI) improvers. A plethora of patents teaching the preparation of these compounds is available. A sampling of these patents which are hereby incorporated by reference are U.S. Pat. Nos. 4,089,794; 4,171,273; 4,670,173; 4,517,104; 4,632,769; and 5,512,192. Typical preparation involves pre-grafting olefin copolymers with ethylenically unsaturated carboxylic acid materials to produce an acylated VI improver. The acyl groups are then reacted with polyamines to form carboxylic acid amides and succinimides.

Another class of polyamine dispersants is Mannich base compositions. Typical Mannich bases which can be used in this invention are disclosed in U.S. Pat. Nos. 3,368,972, 3,539,663, 3,649,229, and 4,157,309. Mannich bases are typically prepared from alkylphenol having alkyl groups from 9 to 200 carbon atoms, an aldehydes, such formaldehyde and polyalkenylamine compounds, such triethylene tetramine, tetraethylene pentamine, and mixtures thereof.

The preferred method of preparing organoammonium tungstates from alkyl mono-amines involves a two phase reaction of aqueous tungstic acid solution with the alkyl mono-amine preferably diluted in organic solvent or diluent oil as described in Tynik, U.S. Patent Application 2004/0214731 A1. After appropriate amount of mixing and heating, phases are allowed to separate and crude organoammonium oxotungstates product is isolated. Product is vacuum distilled to remove traces of water and organic solvent if used. The preferred stoichiometric ratio of tungstic acid to alkyl mono-amine is 0.5 to 1.0. Most preferable stoichiometry is one mole of mono-amine per one mole of tungstic acid.

For dispersant tungstates, one method of preparation involves a two phase reaction of aqueous tungstic acid solution with polyamine dispersant, the polyamine dispersant preferably diluted in oil. After appropriate reaction time, water is removed by vacuum distillation. The preferred stoichiometric ratio of tungstic acid to aminic nitrogen is 0.1 to 1.0, preferably 0.5 to 1.0, and most preferably 0.8 to 1.0. Second method preparation involves three phase reaction consisting of polyamine dispersant, solid tungsten acid, $WO_3.H_2O$, and water. After appropriate reaction time, water is removed by vacuum distillation. The preferred stoichiometric ratio of tungstic acid to aminic nitrogen is 0.1 to 1.5, preferably 0.5 to 1.0, and most preferably 0.8 to 1.0.

The additive combination of the invention is used together with a lubricating oil to form a lubricating oil composition, wherein the lubricating oil comprises at least 50 mass percent thereof. The combination of secondary diarylamine component and organoammonium tungstate is particularly useful in enhancing antioxidant properties when the total amount of these two components as part of a lubricating composition ranges from 0.10-5.0 mass percent. Particularly useful are lubricating compositions containing 0.1-4.0 mass percent (1,000-40,000 ppm) of secondary diarylamine component and 0.005-0.5 mass percent (50-5,000 ppm) tungsten from the organoammonium tungstate. Preferably, the lubricating compositions contain 0.5-2.0 mass percent (5,000-20,000 ppm) of secondary diarylamine component and 0.05-0.3 mass percent (500-3,000 ppm) tungsten from organoammonium tungstate. The invention also comprises lubricating compositions wherein the secondary diarylamine: organoammonium tungstate ratios are 20:1 to 1:30 by mass. Preferably, the ratios are 9:1 to 1:9 by mass, and most preferably 3:1 to 1:3. In terms of secondary diarylamine versus tungsten content, ratios are 70:1 to 1:3 by mass. Preferably, the ratios are 30:1 to 1:1 by mass, and most preferably 16:1 to 2:1.

The oil component of this invention may be one or combination of any mineral or synthetic oils of lubricating viscosity used as lubricant base stocks. Mineral oils may be paraffinic or naphthenic. Paraffinic oils may be Group I solvent refined base oils, Group II hydrocracked base oils, and Group III high viscosity index hydrocracked base oils. Synthetic oils may consist of Group IV polyalphaolefin (PAO) type, and Group V synthetic oils, which include diesters, polyol esters, polyalkylene glycols, alkyl benzenes, organic esters of phosphoric acids, and polysiloxanes.

In addition to secondary diarylamine and organoammonium tungstate, lubricating composition may also include additional antioxidants, additional dispersants, and detergents, additional antiwear additives including ZDDP, friction modifiers, viscosity modifiers, pour point depressants, antifoam additives, and demulsifiers.

To illustrate various organoammonium tungstate compositions which may be used in the invention, the following methods preparation are provided as illustrative examples. The following examples are provided for illustrative purposes only and are not to place any limitation on the scope of the invention where such scope is set out only in the claims.

Example 1

Preparation Di-($C_{11}$-$C_{14}$-branched and linear alkyl) Ammonium Tungstate Sodium tungstate dihydrate (132.0 g) is dissolved in 250.0 g of water and then slowly acidified with 138.7 g of a 26.8% sulfuric acid solution. A solution of di-($C_{11}$-$C_{14}$-branched and linear alkyl) amine (97.7%; 157.9 g) in 150 g heptanes is then charged as a whole to the turbid light-yellow tungsten solution under vigorous stifling. The reaction mixture is then heated to reflux for 30 minutes, after which the aqueous phase is separated and the organic phase is transferred to a rotary evaporator whereupon solvent is removed. Residual solids are removed via filtration. Product is then obtained as clear yellow viscous oil. Tungsten content was determined to be 29.5 mass percent.

Example 2

Preparation Ammonium Tungstate from PIB Mono-Succinimide Polyamine Dispersant Sodium tungstate dihydrate (33.0 g) is dissolved in 75.0 g of water and then slowly acidified with 35.3 g of a 28% sulfuric acid solution. A solution of 105.8 g of a mono-succinimide dispersant (OLOA® 371; 46.7% active in process oil; TBN=53.0) and 65.0 g of process oil is warmed to 50° C. and charged as a whole to the turbid light-yellow tungsten solution under vigorous stirring, along with 4 drops of Antifoam B®. The reaction mixture is then heated at reflux until approximately 75% of the water is distilled off. Vacuum is then slowly applied and the temperature is raised to 125-130° C. and held for 30 minutes. The reaction mixture is then filtered hot through diatomaceous earth yielding clear viscous dark amber oil. Tungsten content was determined to be 9.67 mass percent.

Example 3

Preparation Ammonium Tungstate from PIB (Polyisobutylene) Mono-Succinimide Polyamine Dispersant To a solution of 46.9 g of dispersant (OLOA® 11000; 71.2% active in process oil; TBN=76.3) and 64.5 g of process oil is charged 16.0 g of tungstic acid and 16 g of water. The stirred solution is then heated 100° C. over 10 minutes and then slowly heated to 160° C. over 1 hour while collecting distillate. When distillation ceases, vacuum is applied to the system and the reaction is continued at 160° C. with stifling until the reaction mixture is brown. It is then filtered hot through a diatomaceous earth. Tungsten content was determined to be 5.31%.

Example 4

Preparation Ammonium Tungstate from PIB Mono-Succinimide Polyamine Dispersant

To a solution of 50.2 g of dispersant (60% active in process oil; $PIB_{MW}$=2100; TBN=87.8) and 50.1 g of process oil is charged 7.6 g of tungstic acid and 7.6 g of water. The stirred slurry is then heated to 120° C. and distillation of water begins. The temperature is then slowly increased to 160° C. and the reaction begins to turn green as distillation continues. When distillation ceases, vacuum is applied to the system and the reaction is continued at 160° C. with stirring until the reaction mixture is brown. It is then filtered hot through a diatomaceous earth. Tungsten content was determined to be 2.6 mass percent.

Example 5 Preparation Ammonium Tungstate from PIB Mono-Succinimide Polyamine

Dispersant

To a solution of 46.5 g of a mono-succinimide dispersant (60% active in process oil; $PIB_{MW}$=2100; TBN=44.30) and 46.5 g of process oil is charged 9.0 g of tungstic acid and 10.6 g of water. The stirred slurry is then slowly heated to 160° C. with reflux. At 160° C. distillate is collected causing a color change to olive green. When distillation ceases, vacuum is applied to the system and the reaction is continued at 160° C. with stirring until the reaction mixture is brown. It is then filtered hot through a diatomaceous earth. Tungsten content was determined to be 4.4 mass percent.

Example 6

Preparation Ammonium Tungstate from PIB Mono-Succinimide Polyamine Dispersant

To a solution of 49.8 g of a mono-succinimide dispersant (60% active in process oil; $PIB_{MW}$=1000; TBN=33.52) and 49.9 g of process oil is charged 19.6 g of tungstic acid and 15.1 g of water. The stirred slurry is then slowly heated to 160° C. and the distillate collected as the mixture turns dark green. When distillation ceases, vacuum is applied to the system and the reaction is continued at 160° C. with stifling until the reaction mixture is brown. It is then filtered hot through a diatomaceous earth. Tungsten content was determined to be 8.72 mass percent.

Example 7

Preparation Ammonium Tungstate from PIB Bis-Succinimide Polyamine Dispersant

To a solution of 67.42 g of a bis-succinimide dispersant (HiTEC® 644) approximately 75% active in process oil; TBN=47.20) and 16.8 g of process oil is charged 14.24 g of tungstic acid and 9.35 g of water. The stirred slurry is then heated to 99-101° C. for 1.5 hours. It is then slowly heated to 160° C. over 2.5 hours and held at 160° C. for 1.5 hours while the distillate is collected and the mixture turns green. When distillation ceases, vacuum is applied to the system and the reaction is continued at 160° C. with stifling until the reaction mixture is brown. It is then filtered hot through a diatomaceous earth. Tungsten content was determined to be 4.52 mass percent.

Example 8

Preparation Ammonium Tungstate from PIB Mono-Succinimide Polyamine Dispersant

To a solution of 50.5 g of a mono-succinimide dispersant (60% active in process oil; $PIB_{MW}$=2100; TBN=44.30) and 50.5 g of process oil is charged 5.01 g of tungstic acid and 4.22 g of water. The stirred slurry is then slowly heated to 160° C., at which point the distillate collected as the mixture turns dark green. When distillation ceases, vacuum is applied to the system and the reaction is continued at 160° C. with stirring until the reaction mixture is brown. It is then filtered hot through a diatomaceous earth. Tungsten content was determined to be 1.9 mass percent.

To illustrate various functional fluid compositions, specifically lubricant compositions, comprising the compositions of the present invention, the following illustrative examples are provided. The following examples are provided for illustrative purposes only and are not to place any limitation on the scope of the invention where such scope is set out only in the claims.

Oxidation Stability Testing

Oxidation stability was measured by pressurized differential scanning calorimetry (PDSC) as described by ASTM D 6186. PDSC measures oxidation stability by detecting exothermic release of heat when antioxidant capacity of a lubricating composition is depleted and the base oil goes into oxidative chain reaction known as autooxidation. The time from the start of the experiment to autooxidation is known as oxidation induction time (OIT). Thus, longer OIT's indicate greater oxidative stability and antioxidant capacity.

Example 9

Di-($C_{11}$-$C_{14}$-branched and linear alkyl) ammonium tungstate of Example 1 and VANLUBE® 961, an octylated/butylated secondary diarylamine supplied by R. T. Vanderbilt Company, Inc., were blended with Unocal 90 Group I base oil as shown in Table 2. The oxidation stability of these oils was determined by PDSC as described in ASTM D 6186. The data as summarized in Table 2 shows that the ammonium tungstate alone provides almost no protection against oxidation while VANLUBE® 961 as expected is an efficient antioxidant. More importantly and unexpectedly, the data shows the antioxidant capacity of VANLUBE® 961 is significantly increased in the presence of ammonium tungstate in a wide range secondary diarylamine:tungsten content ratio. Particularly effective are ratios between 16:1 and 5:1.

Example 10

Di-($C_{11}$-$C_{14}$-branched and linear alkyl) ammonium tungstate of Example 1 and VANLUBE® 81, a p,p'-dioctylated secondary diarylamine supplied by R. T. Vanderbilt Company Inc. were blended with Unocal 90 Group I base oil as shown in Table 3. The oxidation stability of these oils was determined by PDSC as described ASTM D 6186. The data as summarized in Table 3 shows that the ammonium tungstate of Example 1 alone provides almost no protection against oxidation while VANLUBE® 81 as expected is an efficient antioxidant. More importantly and unexpectedly, the data shows the antioxidant capacity of VANLUBE® 81 is significantly increased in the presence ammonium tungstate.

TABLE 2

| Components | Mass Percent | | | | | | | | | | |
|---|---|---|---|---|---|---|---|---|---|---|---|
| Example 1 | 0.5 | 1.0 | 0.554 | 0.50 | 0.352 | 0.27 | 0.187 | 0.10 | 0.05 | 0 | 0 |
| VANLUBE ® 961 | 0 | 0 | 0.446 | 0.50 | 0.648 | 0.73 | 0.813 | 0.90 | 0.95 | 1.0 | 0.5 |
| Unocal 90 Oil | 99.8 | 99.0 | 99.0 | 99.0 | 99.0 | 99.0 | 99.0 | 99.0 | 99.0 | 99.0 | 99.5 |
| OIT, minutes | 7.7 | 4.08 | 49.75 | 48.61 | 65.08 | 76.62 | 62.16 | 56.70 | 41.85 | 27.32 | 16.7 |
| Tungsten Content, ppm | 1,320 | 2,640 | 1,463 | 1,320 | 1,038 | 713 | 495 | 264 | 132 | 0 | 0 |
| Secondary Diarylamine Content (ppm)/W Content (ppm) | 0 | 0 | 3.04 | 3.79 | 6.24 | 10.23 | 16.42 | 34.09 | 71.97 | — | — |

Example 1 is di-($C_{11}$-$C_{14}$-branched and linear alkyl) ammonium tungstate with tungsten content of 26.4 mass percent.
VANLUBE ® 961 is an octylated/butylated secondary diarylamine supplied by R. T. Vanderbilt Company Inc.

TABLE 3

| Components | Mass Percent | | | |
|---|---|---|---|---|
| Example 1 | 1.0 | 0.50 | 0.25 | 0 |
| VANLUBE ® 81 | 0 | 0.50 | 0.75 | 1.0 |
| Unocal 90 Oil | 99.0 | 99.0 | 99.0 | 99.0 |
| OIT, minutes | 4.08 | 68.61 | 89.19 | 16.4 |
| Tungsten Content, ppm | 2,640 | 1,320 | 660 | 0 |
| Secondary Diarylamine Content (ppm)/W Content (ppm) | 0 | 3.79 | 11.36 | — |

Example 1 is di-($C_{11}$-$C_{14}$-branched and linear alkyl) ammonium tungstate with tungsten content of 26.4 mass percent.
VANLUBE ® 81 is an p,p'-dioctylated secondary diarylamine supplied by R. T. Vanderbilt Company Inc.

Example 11

Di-($C_{11}$-$C_{14}$-branched and linear alkyl) ammonium tungstate of Example 1 and VANLUBE® SL, an octylated/styrenated secondary diarylamine supplied by R. T. Vanderbilt Company were blended Unocal 90 Group I base oil as shown in Table 4. The oxidation stability of these oils was determined by PDSC as described ASTM D 6186. The data as summarized in Table 4 shows that the ammonium tungstate provides almost no protection against oxidation while VANLUBE® SL as expected is an efficient antioxidant. More importantly and unexpectedly, the data shows the antioxidant capacity of VANLUBE® SL is significantly increased in the presence ammonium tungstate.

TABLE 4

| Components | Weight Percent | | | |
|---|---|---|---|---|
| Example 1 | 1.0 | 0.50 | 0.25 | 0 |
| VANLUBE ® SL | 0 | 0.50 | 0.75 | 1.0 |
| Unocal 90 Oil | 99.0 | 99.0 | 99.0 | 99.0 |
| OIT, minutes | 4.08 | 35.9 | 69.0 | 21.4 |
| Tungsten Content, ppm | 2,640 | 1,320 | 660 | 0 |
| Secondary Diarylamine Content (ppm)/W Content (ppm) | 0 | 3.79 | 11.36 | — |

Example 1 is di-($C_{11}$-$C_{14}$-branched and linear alkyl) ammonium tungstate with tungsten content of 26.4 mass percent.
VANLUBE ® SL is an octylated/styrenated secondary diarylamine supplied by R. T. Vanderbilt Company Inc.

Example 12

Ammonium tungstate of PIB mono-succinimide polyamine dispersant of Example 2 and various secondary diarylamines were blended Unocal 90 Group I base oil as shown in Table 5. The oxidation stability of these oils was determined by PDSC as described ASTM D 6186. The data as summarized in Table 5 shows that the ammonium tungstate provides almost no protection against oxidation while secondary diarylamines as expected are an efficient antioxidant. More importantly and unexpectedly, the data shows the antioxidant capacity of all the secondary diarylamines is significantly increased in the presence ammonium tungstate.

TABLE 5

| Components | Weight Percent | | | |
|---|---|---|---|---|
| Example 2 | 1.00 | 0.50 | 0.50 | 0.50 |
| VANLUBE ® SL | | 0.50 | | |
| VANLUBE ® 81 | | | 0.50 | |
| VANLUBE ® 961 | | | | 0.50 |
| Unocal 90 Oil | 99.0 | 99.0 | 99.0 | 99.0 |
| OIT, minutes | 3.79 | 45.3 | 48.7 | 48.2 |
| Tungsten Content, ppm | 967 | 483.5 | 483.5 | 483.5 |
| Secondary Diarylamine Content (ppm)/W Content (ppm) | 0 | 10.34 | 10.34 | 10.34 |

Example 2 is ammonium tungstate of PIB mono-succinimide polyamine dispersant with tungsten content of 9.67 mass percent.

Example 13

Ammonium tungstate of PIB mono-succinimide polyamine dispersant of Example 2 and VANLUBE® SL, an octylated/styrenated secondary diarylamine supplied by R. T. Vanderbilt Company were blended Unocal 90 Group I base oil as shown in Table 6. The oxidation stability of these oils was determined by PDSC as described ASTM D 6186. The data shows that dispersant tungstate of Example 2 improves antioxidant capacity of over wide range of secondary diarylamine concentrations and at high ammonium tungstate concentration which that will provide lubricating compositions with effective antiwear protection and dispersant levels that are close to typical.

TABLE 6

| Components | Weight Percent | | | | | | |
|---|---|---|---|---|---|---|---|
| Example 2 | 0 | 0 | 0 | 3.0 | 3.0 | 3.0 | 3.0 |
| VANLUBE ® SL | 0.10 | 0.50 | 2.0 | 0 | 0.10 | 0.5 | 2.0 |
| Unocal 90 Oil | 99.9 | 99.5 | 98.0 | 97.0 | 96.9 | 96.5 | 95.0 |
| OIT, minutes | 8.2 | 15.8 | 47.0 | 4.0 | 19.3 | 84.2 | 234.2 |
| Tungsten Content, ppm | 0 | 0 | 0 | 2,901 | 2,901 | 2,901 | 2,901 |
| Secondary Diarylamine Content (ppm)/W Content (ppm) | — | — | — | 0 | 0.34 | 1.72 | 6.89 |

Example 13

Ammonium tungstates of PIB succinimide polyamine dispersants of Examples 2, 3, 4, 5, 6, 7 and 8 and VANLUBE® SL, an octylated/styrenated secondary diarylamine supplied by R. T. Vanderbilt Company were blended Unocal 90 Group I base oil as shown in Table 7. The oxidation stability of these oils was determined by PDSC as described ASTM D 6186. The data shows that all ammonium tungstates are effective synergists regardless of PIB molecular weight, TBN, method of preparation and tungsten loading as summarized in Table 8.

TABLE 7

| Components | Weight Percent | | | | | | | |
|---|---|---|---|---|---|---|---|---|
| VANLUBE ® SL | 0.5 | 0.5 | 0.5 | 0.5 | 0.5 | 0.5 | 0.5 | 0.5 |
| Example 2 | | 3.0 | | | | | | |
| Example 3 | | | 3.0 | | | | | |
| Example 4 | | | | 3.0 | | | | |
| Example 5 | | | | | 3.0 | | | |
| Example 6 | | | | | | 3.0 | | |
| Example 7 | | | | | | | 3.0 | |
| Example 8 | | | | | | | | 3.0 |
| Unocal 90 Oil | 99.5 | 96.5 | 96.5 | 96.5 | 96.5 | 96.5 | 96.5 | 96.5 |
| OIT, minutes | 15.8 | 84.2 | 41.0 | 30.3 | 26.9 | 52.3 | 55.3 | 55.4 |
| Tungsten Content, ppm | 0 | 2901 | 1683 | 786 | 1308 | 2616 | 1356 | 570 |
| Secondary Diarylamine Content (ppm)/W Content (ppm) | 0 | 1.72 | 2.97 | 6.36 | 3.82 | 1.91 | 3.69 | 8.77 |

TABLE 8

| Example No. | Dispersant Type | PIB M.W. | TBN | Method of Preparation | Tungsten Content, WT. % |
|---|---|---|---|---|---|
| 2 | Mono-succinimide[1] | | 53.0 | Tynik, U.S. patent Application 2004/0214731 A1 | 9.67 |
| 3 | Mono-succinimide[2] | | 76.3 | 3-Phase Method: Dispersant, Solid $WO_3 \cdot H_2O$, and Water | 5.31 |
| 4 | Mono-succinimide | 2,100 | 87.8 | 3-Phase Method: Dispersant, Solid $WO_3 \cdot H_2O$, and Water | 2.62 |
| 5 | Mono-succinimide | 2,100 | 44.3 | 3-Phase Method: Dispersant, Solid $WO_3 \cdot H_2O$, and Water | 4.36 |
| 6 | Mono-succinimide | 1,000 | 33.52 | 3-Phase Method: Dispersant, Solid $WO_3 \cdot H_2O$, and Water | 8.72 |
| 7 | Bis-succinimide[3] | | 47.20 | 3-Phase Method: Dispersant, Solid $WO_3 \cdot H_2O$, and Water | 4.52 |
| 8 | Mono-succinimide | 2,100 | 44.3 | 3-Phase Method: Dispersant, Solid $WO_3 \cdot H_2O$, and Water | 1.9 |

[1]Mono-succinimide is Chevron ORONITE ® OLOA 371.
[2]Mono-succinimide is Chevron ORONITE ® OLOA 11000.
[3]Bis-succinimide is HiTEC ® 644 supplied by Afton Chemical Company.

What is claimed is:

1. A lubricating composition comprising a major amount of a lubricating oil and 0.5-5.0 mass percent of an additive, the additive comprising a secondary diarylamine at about 0.5-2.0 mass percent, and an organoammonium tungstate in an amount which provides about 50-3,000 ppm tungsten, wherein the organoammonium tungstate is a reaction product of (a) a tungsten source and (b) di-($C_{11}$-$C_{14}$-branched and linear alkyl) amine, or a mono- or bis-substituted succinimide.

2. The lubricating composition of claim 1, wherein the mass ratio of secondary diarylamine to tungsten is about 75:1 to about 1:3.

3. The lubricating composition of claim 2, wherein the mass ratio of secondary diarylamine to tungsten is about 35:1 to about 1:3.

4. The lubricating composition of claim 3, wherein the mass ratio of secondary diarylamine to tungsten is about 16:1 to about 2:1.

5. The lubricating composition of claim 3, wherein the secondary diarylamine comprises

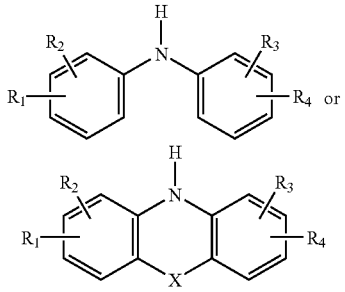

wherein $R_1$, $R_2$, $R_3$, and $R_4$ each independently represent hydrogen, alkyl, aralkyl, aryl, and alkaryl groups having 1 to about 20 carbons atoms per each group, wherein X is either $(CH_2)_n$, S, or O and n is 0 to 2, or X is two hydrogens bound to their respective carbons in a secondary diphenylamine structure.

6. The lubricating composition of claim 5, wherein at least one of $R_1$, $R_2$, $R_3$, and $R_4$ are each independently chosen from hydrogen, 2-methyl propenyl, 2,4,4-trimethyl pentenyl, styrenyl and nonyl.

7. The lubricating composition of claim 5, wherein the secondary diarlyamine is chosen from octylated/butylated secondary diarylamine, p,p'-dioctylated secondary diarylamine and octylated/styrenated secondary diarylamine.

8. The lubricating composition of claim 1, wherein the tungsten source is chosen from tungstic acid, tungsten trioxide, ammonium tungstate, ammonium paratungstate, sodium tungstate dihydrate, calcium tungstate and ammonium metatungstate.

9. The lubricating composition of claim 1, wherein component (b) is the di-($C_{11}$-$C_{14}$-branched and linear alkyl) amine.

10. The lubricating composition of claim 1, wherein component (b) is the mono- or bis-substituted succinimide.

11. The lubricating composition of claim 10, wherein the mono- or bis-substituted succinimide is of the formula:

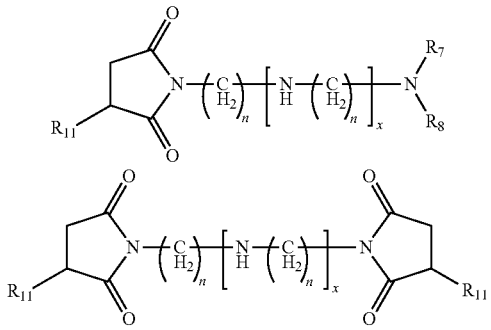

wherein $R_{11}$ is 8 to 400 carbon atoms.

12. The lubricating composition of claim 11, wherein $R_{11}$ is 50 to 200 carbon atoms.

13. The lubricating composition of claim 12, wherein the mono- or his-substituted succinimide is derived from polyisobutenyl having molecular weight ranging from 800-2,500 grams per mole and a polyethylene amine.

* * * * *